US005370248A

United States Patent [19]

Robolin

[11] Patent Number: 5,370,248

[45] Date of Patent: Dec. 6, 1994

[54] ADJUSTABLE GARMENT RACK

[75] Inventor: Claude J. Robolin, Lavonia, Ga.

[73] Assignee: RHC/Spacemaster Corporation, Melrose Park, Ill.

[21] Appl. No.: 890,522

[22] Filed: May 28, 1992

[51] Int. Cl.[5] ..... A47B 43/00

[52] U.S. Cl. ..... 211/189; 211/203; 211/205; 211/207; 403/218; 248/188.7

[58] Field of Search ..... 211/189, 182, 190, 196, 211/207, 203, 205; 403/217, 218; 248/188.7, 512, 519, 165, 188.3

[56] References Cited

U.S. PATENT DOCUMENTS

| | | | |
|---|---|---|---|
| 1,258,518 | 3/1918 | Ankovitz | 211/203 X |
| 1,353,670 | 9/1920 | Straith | 211/196 |
| 1,496,465 | 6/1924 | Jackson | 248/165 |
| 1,764,072 | 6/1930 | Frazier et al. | 248/188.7 |
| 1,970,215 | 8/1934 | Barnett | 40/531 |
| 2,368,740 | 2/1945 | Blongren | 211/189 X |
| 2,664,320 | 12/1953 | Fox | 403/218 |
| 3,060,258 | 10/1962 | Spurgeon | 403/218 X |
| 3,313,505 | 4/1967 | Petrie | 268/165 |
| 3,653,698 | 4/1972 | Jenner | 403/217 X |
| 3,807,574 | 4/1974 | Lanza | 211/207 |
| 3,893,774 | 7/1975 | Hashioka | 211/182 X |
| 4,126,288 | 11/1978 | De Sisto et al. | 211/182 X |
| 4,380,298 | 4/1983 | Harig | 211/189 |
| 4,469,030 | 9/1984 | Hopwell | 211/182 X |
| 4,629,078 | 12/1986 | Korth | 211/207 |
| 4,767,014 | 8/1988 | Vail, Sr. et al. | 211/190 X |
| 5,044,507 | 9/1991 | Shulyak | 211/203 |
| 5,108,141 | 4/1992 | Anderson | 211/189 X |

FOREIGN PATENT DOCUMENTS

| | | | |
|---|---|---|---|
| 2194435 | 3/1988 | United Kingdom | 211/191 |

*Primary Examiner*—Alvin C. Chin-Shue
*Assistant Examiner*—Korie H. Chan

[57] ABSTRACT

A garment rack having a pedestal base and parallel posts extending upwardly therefrom. Each post telescopically receives an extender which mounts a garment support at its upper end. A cap receives and houses the upper ends of the posts. The bases of the extenders provide guides for stabilizing them in the posts against wobble relative to the posts.

6 Claims, 3 Drawing Sheets

Fig. 1
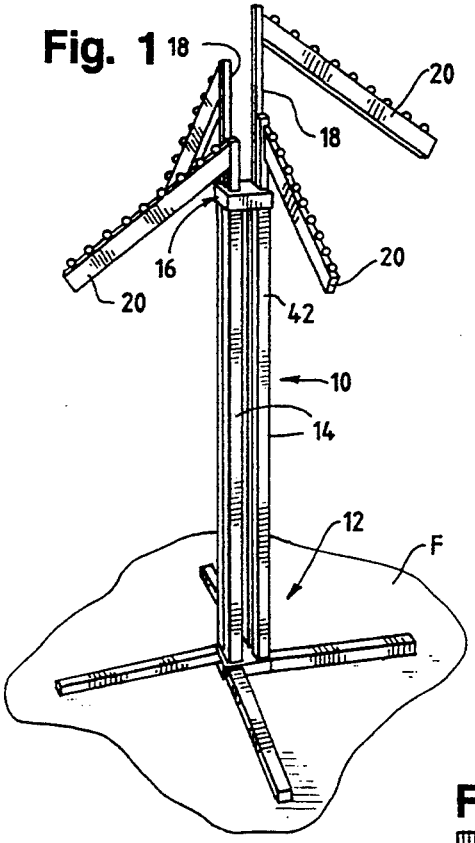
Fig. 2
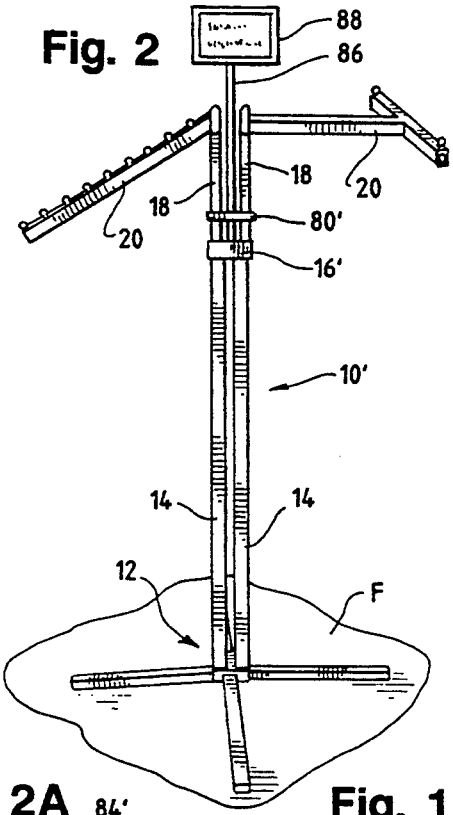
Fig. 2A
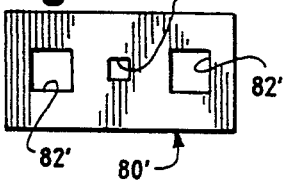
Fig. 1A
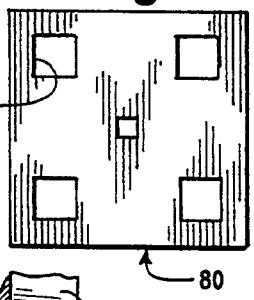
Fig. 3
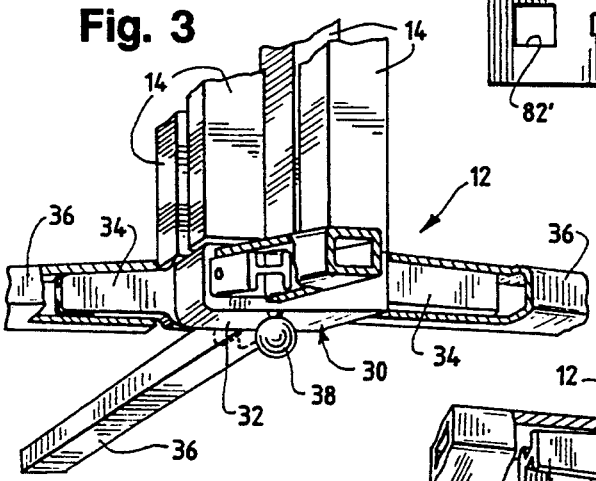
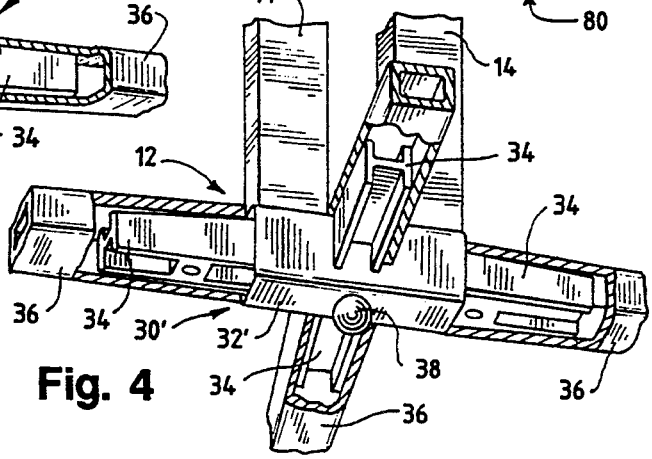
Fig. 4

Fig. 5
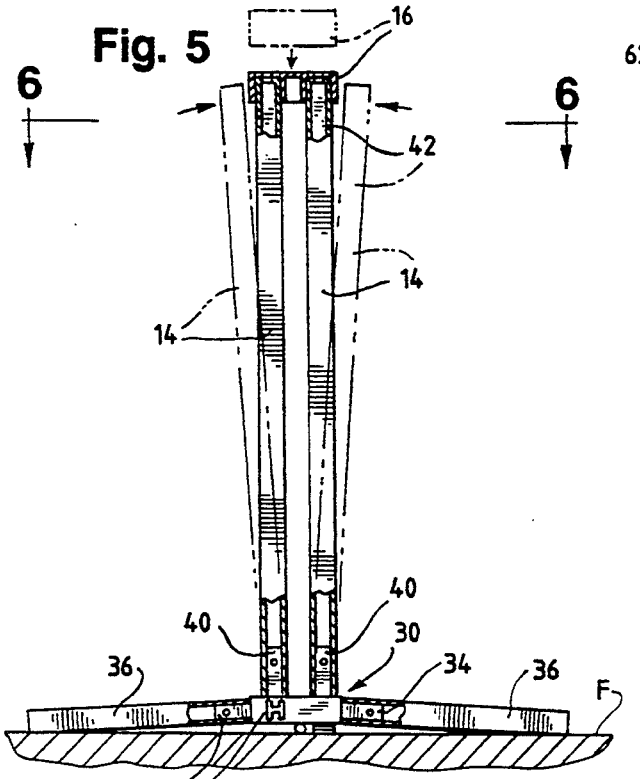
Fig. 9
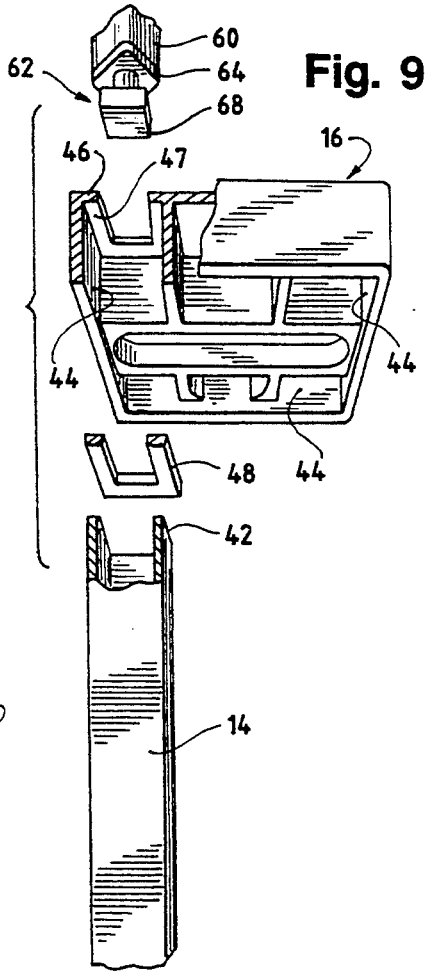
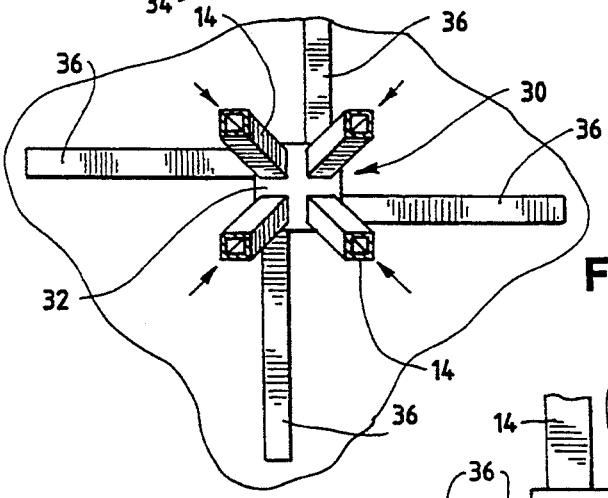
Fig. 6
Fig. 7
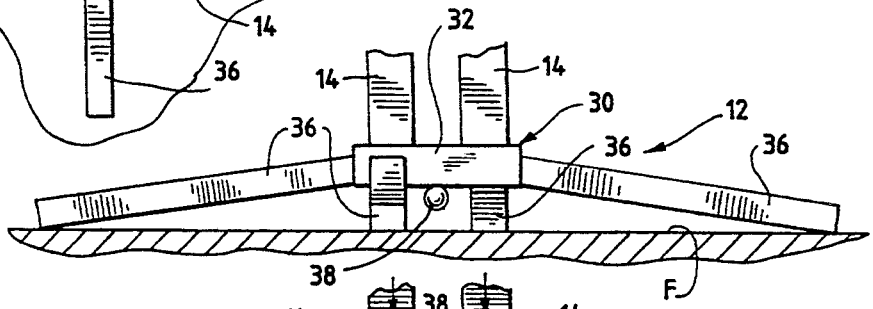
Fig. 8
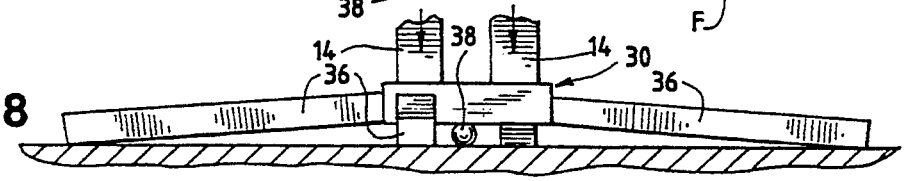

ADJUSTABLE GARMENT RACK

BACKGROUND OF THE INVENTION

This invention relates to garment racks for use for displaying merchandise, such as clothing hung on hangers.

A wide variety of such racks are available and in use. It is important that such racks be assemblable quickly, and preferably with a minimum or absence of tools. It is also desirable that as few fasteners as possible be used, so that assembly is quicker, and so that assembly is not impeded by lost parts and the like.

It is also important that a rack be easily assembled and disassembled and that telescoping parts be protected against damage of the decorative surfaces of the parts. If such damage is avoided, parts of the rack need not be replaced when the array presented by the rack is altered.

These desiderata will preferably all be found in a single rack, and it is with such a rack that this invention is concerned.

SUMMARY OF THE INVENTION

An adjustable garment rack which may be quickly assembled from components without fasteners and tools in accordance with this invention comprises a pedestal base section, at least two hollow substantially parallel posts extending upwardly from the base section, a cap receiving the upper ends of each of the posts for securing the upper ends thereto without fasteners and for maintaining the posts in their parallel relationship, and elongated extenders having upper and lower portions and being telescopically disposed in the posts, with the upper portions projecting outwardly above the cap for supporting garments therefrom.

The pedestal base section includes at least three support legs which project laterally outwardly and downwardly therefrom at a slight angle, with the central zone of the pedestal base section directly underlying the posts and being spaced upwardly from the outer ends of the support legs, whereby under vertical loading of the rack the central zone of the garment rack may move downwardly relative to a support surface for the pedestal base section. A stop is provided in the central zone for confronting the support surface to limit downward movement of the central zone under vertical loading.

The pedestal base section may also include a fitting having at least three plugs which project laterally and downwardly therefrom at a slight angle for frictionally mounting the support legs and may desirably also mount at least two stubs which extend upwardly and outwardly therefrom at a slight angle for frictionally mounting the lower ends of the posts.

Preferably the posts extend upwardly from the pedestal section and incline slightly outwardly requiring that they be sprung inwardly as a group to secure their upper ends to the cap, so that the posts are biased outwardly at their upper ends against the cap. Desirably the cap frictionally receives the post upper ends in cavities defined therein.

The cap defines openings directly in line with the posts through which lower portions of the extenders extend. Additionally means for stabilizing the extenders against wobble relative to the associated posts are provided as well. These stabilizing means may include inserts both for preventing scratching of the extenders when they telescope relative to the cap and for stabilizing the extenders against wobble.

Each extender mounts a stabilizing guide for preventing wobble of the extender relative to the post, both when it telescopes relative to the cap and when the garment rack is in use. When each post is substantially square in internal cross-section, each extender is desirably square as well, the guide includes a portion which may be substantially square and is offset by 45 degrees from the square projection of the extender, all so that when the extender enters the upper end of the post and is oriented properly, the corners of the guide confront the walls of the post to stabilize the extender against wobble relative to the associated post.

Further objects, features and advantages of the present invention will become apparent from the following description and drawings.

BRIEF DESCRIPTION OF THE DRAWINGS

FIG. 1 is a perspective view of a garment rack in accordance with the present invention;

FIG. 1A is a plan view of a sign holder guide to be used with the garment rack of FIG. 1;

FIG. 2 is a perspective view of a further garment rack of the present invention;

FIG. 2A is a plan view of the sign holder guide of the garment rack of FIG. 2;

FIG. 3 is an enlarged fragmentary perspective view of a base portion of FIG. 1;

FIG. 4 is an enlarged fragmentary perspective view of a base portion of FIG. 2;

FIG. 5 is a fragmentary side elevational view of a portion of the garment rack of FIG. 1;

FIG. 6 is a cross-sectional view taken substantially along line 6—6 of FIG. 5 in the phantom position of FIG. 5;

FIG. 7 is a fragmentary side elevational view of a base portion of the garment rack of FIG. 1;

FIG. 8 is a view similar to that of FIG. 7 with the garment rack loaded;

FIG. 9 is an exploded, fragmentary perspective view of an upper portion of the garment rack of FIG. 1;

FIG. 15 is a partially sectioned and broken away side view of the parts of FIG. 13, but in a partially assembled state.

DETAILED DESCRIPTION OF THE PREFERRED EMBODIMENTS

Figure 11:
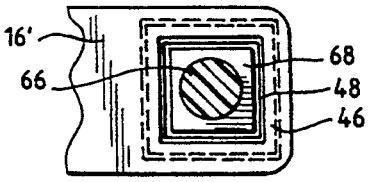
FIG. 11 is a fragmentary cross-sectional view taken along line 11—11 of FIG. 10.

Referring now to the drawings, FIG. 1 illustrates a garment rack 10 employing the principles of the present invention. Rack 10 comprises a pedestal base assembly 12, a plurality of hollow upstanding substantially parallel posts 14 extending upwardly from the pedestal base, a cap 16 receiving the upper ends of the posts 14, and extenders 18 projecting upwardly and outwardly from the posts. The extenders 18 mount hanger rods 20 of various types. All may be of suitably finished metal. The posts and extenders may be of square metal tubing.

Referring now to FIGS. 3, 5, 6, 7 and 8, it will be seen that the pedestal assembly 12 comprises a central fitting 30 having a base section 32 and at least three and preferably four plugs 34. Each plug 34 extends outwardly and downwardly from the base, say at an angle of 2 to 3 degrees. Each plug 34 is proportioned to be inserted into, and to frictionally receive a support or pedestal leg 36 which is hollow and which is adapted to be supported on a surface such as a floor F. Although suitable set screws may be used to permanently secure the legs 36 to the plugs 34 so that they are permanently connected, that is not necessary because the friction fit is preferably sufficient to retain the legs 36 on the plugs 34. The central fitting mounts a central stop 38, as at its center and on its underside for confronting a support surface, such as floor F, so that it will limit the deflection of the legs and downward movement of the fitting 30 as the rack is loaded vertically (see FIGS. 7 and 8).

Central fitting 30 also provides a plurality of generally vertically extending stubs 40 (FIG. 5). Stubs 40 may be integrally formed with base portion 30 (as may be plugs 34), all as part of a casting. The pedestal base central fitting 30 may be of cast metal or may be made of a plastic of suitable strength such as, for example, a glass fiber reinforced polypropylene copolymer. Stubs 40 extend upwardly at an angle which departs slightly from true vertical, such as at an angle of perhaps 2 degrees. This is shown in slightly exaggerated fashion in FIGS. 5 and 6 where the posts 14 which are frictionally seated on the stubs 40 cause the posts, in an unrestrained array (FIG. 6 and in dotted line in FIG. 5), to extend upwardly at the angles determined by the angles at which the stubs 40 extend upwardly.

After the posts are so mounted on the stubs 40, the posts are gripped and sprung inwardly so that the upper ends 42 are positioned in the cap 16, such as a metal casting. As seen in FIG. 5 and 6, the ends 42 are each seated, preferably in a frictional or press fit, in a mating cavity 44 defined in the underside of the cap 16. The frictional fit and the provision for the springing-in of the posts as they are inserted into the cavities 44 assures a solid and relatively permanent connection of the posts 14 to the cap 16 without auxiliary securing means, such as screws or the like.

The cap 16 also provides means such as stops 46 for defining the end of the cavities 44 for defining the position which the upper ends 42 of the posts 14 are to assume when they are properly seated in the cap 16. The lower surfaces 47 of the stops 46 serve as a seat for a protective insert 48, as of plastic, the purpose of which is to serve as a guide and as a non-abrasive surface to prevent scratching or damage to the extenders 18. The cap may also be integrally formed of a suitable plastic, such as a glass fiber-filled polypropylene copolymer. In this instance the plastic insert 48 may be integrated with the plastic molding or casting.

Extenders 18 desirably comprise a hollow extender rod 60 and a stabilizing guide and retention foot 62 press-fit into the lower end thereof. Foot 62 may be of a suitable plastic and comprises a plug 64, a connector section 66, and a guide section 68.

Figure 14:
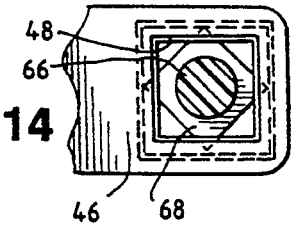
FIG. 14 is a fragmentary cross-sectional view taken along line 14—14 of FIG. 13.
Figure 10:
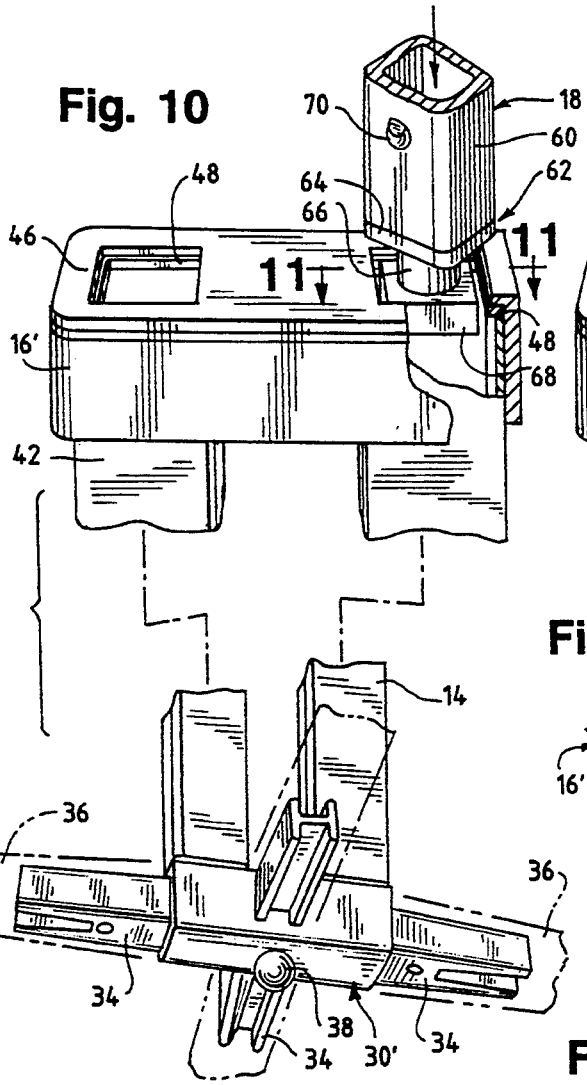
FIG. 10 is a fragmentary, partially broken away, perspective view of the rack of FIG. 2, including a top perspective view of an upper portion of the garment rack.
Figure 13:
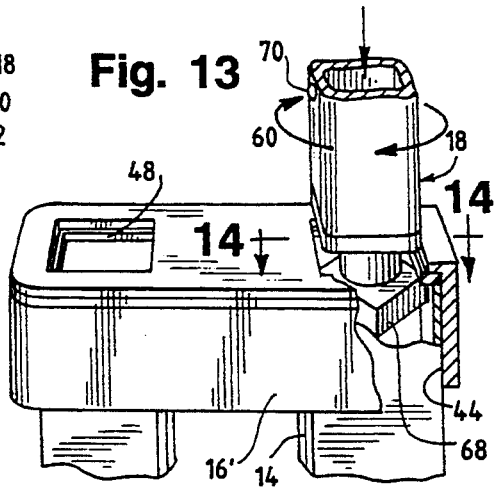
Figure 12:
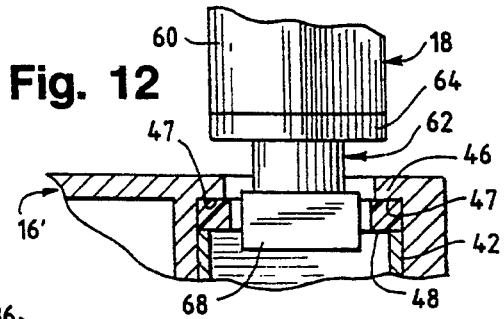
FIG. 12 is a partially sectioned and broken away side view of FIG. 10.
Figure 15:
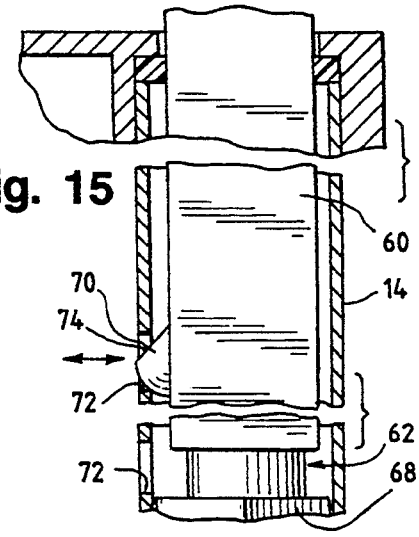
FIG. 15 is a fragmentary top perspective view similar to the view of FIG. 10 with the extender rotated 45°.

Guide section 68 may be square (when the posts 14 are square) and is offset by 45 degrees from the square cross-section of the extender rod itself. The size of the guide section 68 is smaller than the square opening of the insert 48 and than the substantially square inside dimension of the hollow posts 14. However the dimension of the guide section 68 from opposite corners, which may be rounded or flattened if desired to provide even greater stability, is approximately the same as the distance between opposite internal sidewalls of the post 14 as is apparent from FIG. 14.

FIGS. 10–14 illustrate, in part, the embodiment of FIG. 2. However, as far as the manner of securing the extenders 18 to the cap of FIG. 2 is concerned, they are the same as the embodiment of FIG. 1. Thus, referring now to FIG. 10, when an extender 18 is to be secured to a post and cap, the guide and retention foot 62, with the extender rotated 45 degrees out of phase with the post 14, is moved downwardly past the insert 48 until the guide section 68 enters the upper end 42 of a post 14. FIG. 11 shows the relationship of the connector section 66 and guide section 68 relative to the insert 48 and the cap 16.

When the foot 62 is moved downwardly to where the guide section has entered the post 14, the extender, is rotated 45 degrees. At that time the extender is oriented with its walls parallel to the confronting surfaces of insert 48 and the guide section is disposed with its corners confronting and closely adjacent to the centers of the inside walls of the post 14.

As the extender is moved further downwardly into the post 14, the insert 48 guides the extender, and the close adjacency of the guide section 68 and post internal walls promote stability and prevent wobbling of the extender relative to the post, all without scratching or damaging the extender surfaces. Thus the extender is not scratched by the cap when the extender telescopes relative to the cap.

The extenders 18 also mount spring loaded bullet catches 70. The posts define openings 72 at desired vertical elevations into which the bullet catches 70 are adapted to project to fix the elevation of the upper ends of the extenders as desired. Bullet catches 70 may have upper inclined camming surfaces 74 to permit upward extension of the extenders without having to manually depress the catches 70.

Figure 16:
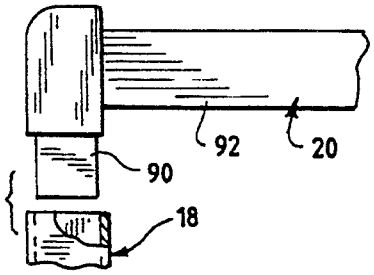
FIG. 16 is a fragmentary, exploded side elevational view of portions of an extender rod and an associated hanger rod of FIG. 2.

Referring now to FIGS. 1 and 16, when the extenders 18 are suitably positioned relative to posts 14, hanger rods 20 may be secured to their upper ends as by clips or as by associated plugs 90 which fit frictionally and telescopically into the upper ends of the extenders. Hanger rods elements 92 with positioning stops may be used as may T-shaped rods as illustrated by FIG. 2 and as may be shown in FIGS. 1 and 2. Other known configurations of hanger rods which may be supported by two of the extenders may be used as well, all as is well-known in the art.

FIGS. 2, 4 and 10–14 illustrate another form of the invention. The rack 10' of that embodiment is the same as that of FIG. 1, except for the fact that it uses only two posts, and therefore the cap and central fitting are appropriately different.

As such central fitting 30' has a base section 32' and but two upwardly extending stubs 40 which, like those of fitting 30, extend upwardly at a slight deviation from vertical so that the posts may be sprung inwardly when they are to be secured to the cap 16'. Cap 16' defines only two cavities 44 for receiving the upper ends of the posts 14. All else may be the same, and accordingly the same part numbers having been used, and the description of them is identical to that of the embodiment of FIG. 1.

To enhance the stability of the garment rack a tie guide, as of a suitable plastic, may be provided to tie the extenders 18 together. As seen in FIG. 2A, the tie guide 80' for the rack of FIG. 2 may define square holes corresponding to the outer dimensions of the extenders, with one such hole 82' for each extender. The center of the tie guide may be provided with an opening 84' to receive the stem 86 of a sign holder 88 to mount a sign holder. The tie guide may be slid onto the extenders before the hanger rods are secured in place. It is slidably mounted on the extenders, but is frictionally held at desired elevations relative to the extenders. The opening 84' for the stem 86 may be square to prevent a square ended stem from rotating, thereby to assure a desired orientation for the sign holder. Preferably the outer plan dimensions of the tie guide 80' are the same as those of the cap 16' to present a pleasing appearance. A tie guide 80 (FIG. 1A) for use with the embodiment of FIG. 1 and having four openings 82 is similarly constructed.

From the foregoing it will be apparent that the garment racks may be assembled and the components secured without extraneous fasteners, with the assurance that they will remain intact and attached in normal use. When desired they may be disassembled without the use of tools.

The extenders will be protected against damage to their outer decorative surfaces so that if it becomes desirable to change their elevations, portions which have entered the interiors of the posts will not be scratched or otherwise damaged.

It will be apparent to those skilled in the art that changes and modifications may be made in the embodiments illustrated without departing from the spirit and scope of the invention. Thus the invention is not to be considered as being limited thereby, except as may be made necessary by the accompanying claims.

What is claimed is:

1. A garment rack having a pedestal base section, at least two hollow substantially parallel posts extending upwardly from the base section, a cap structure defining cavities receiving the upper ends of each of the posts, and said cap structure also overlying the upper ends of said posts for frictionally receiving and securing the upper ends of said posts thereto without fasteners and for maintaining the posts in their parallel relationship, and elongated extenders having upper and lower portions and being telescopically disposed in said posts, with said upper portions projecting outwardly through and above said cap structure for supporting garments therefrom, and wherein said pedestal base section includes at least three support legs which project laterally outwardly and downwardly therefrom at a slight angle, with the central zone of the pedestal base section directly underlying the posts and being spaced upwardly from the outer ends of the support legs, whereby under vertical loading of the rack the central zone of the garment rack may move downwardly relative to a support surface for the pedestal base section, and wherein said pedestal base section further comprises a fitting having at least three plugs which project laterally and downwardly therefrom at a slight angle for frictionally mounting said support legs, and wherein said fitting mounts at least two stubs which extend upwardly and outwardly therefrom at a slight angle for frictionally mounting the lower ends of said posts.

2. A garment rack having a pedestal base section, at least two hollow substantially parallel posts extending upwardly from the base section, a cap structure defining cavities receiving the upper ends of each of the posts, and said cap structure also overlying the upper ends of said posts for frictionally receiving and securing the upper ends of said posts thereto without fasteners and for maintaining the posts in their parallel relationship, and elongated extenders having upper and lower portions and being telescopically disposed in said posts, with said upper portions projection outwardly through and above said cap structure for supporting garments therefrom, and wherein said posts as mounted in said cap structure are outwardly biased against said cavities.

3. A garment rack having a pedestal base section, at least two hollow substantially parallel posts extending upwardly from the base section, a cap structure defining cavities receiving the upper ends of each of the posts, and said cap structure also overlying the upper ends of said posts for frictionally receiving and securing the upper ends of said posts thereto without fasteners and for maintaining the posts in their parallel relationship, and elongated extenders having upper and lower portions and being telescopically disposed in said posts, with said upper portions projection outwardly through and above said cap structure for supporting garments therefrom, and wherein said cap structure defines openings directly in line with said posts through which lower portions of said extenders extend, and means secured to said extenders and provided by said cap structure for stabilizing the extenders against wobble relative to the associated posts, and wherein said cap structure includes inserts to prevent scratching of the extenders when they telescope relative to said cap structure and to stabilize the extenders against wobble.

4. A garment rack having a pedestal base section, at least two hollow substantially parallel posts extending upwardly from the base section, a cap structure defining cavities receiving the upper ends of each of the posts, and said cap structure also overlying the upper ends of said posts for frictionally receiving and securing the upper ends of said posts thereto without fasteners and for maintaining the posts in their parallel relationship, and elongated extenders having upper and lower portions and being telescopically disposed in said posts, with said upper portions projection outwardly through and above said cap structure for supporting garments therefrom, and wherein said cap defines openings directly in line with said posts through which lower portions of said extenders extend, and means secured to said extenders and provided by said cap for stabilizing the extenders against wobble relative to the associated posts, and wherein said each extender mounts a stabilizing guide for preventing wobble of said extender relative to said post, both when it telescopes relative to said cap and when the garment rack is in use, and wherein each post is substantially square in internal cross-section, each extender is square, and said stabilizing guide includes a portion which is substantially square and is offset by 45 degrees from the square projection of the extender, so that when the extender enters the upper end of the post, the corners of the stabilizing guide confront the walls of the post to stabilize the extender thereafter against wobble relative to the associated post.

5. A garment rack having a pedestal base section, at least two hollow substantially parallel posts extending upwardly from the base section, a cap structure defining cavities receiving the upper ends of each of the posts, and said cap structure also overlying the upper ends of said posts for frictionally receiving and securing the upper ends of said posts thereto without fasteners and for maintaining the posts in their parallel relationship, and elongated extenders having upper and lower portions and being telescopically disposed in said posts, with said upper portions projection outwardly through and above said cap structure for supporting garments therefrom, and further including a tie guide slidably mounted on the upper portions of the extenders for tieing the extenders together.

6. A garment rack having a pedestal base section, at least two hollow substantially parallel posts extending upwardly from the base section, a cap receiving the upper ends of each of the posts for securing the upper ends thereto without fasteners and for maintaining the posts in their parallel relationship, and elongated extenders having upper and lower portions and being telescopically disposed in said posts, with said upper portions projecting outwardly above said cap for supporting garments therefrom, and wherein said posts extend upwardly from said pedestal section and incline slightly outwardly requiring that they be sprung inwardly as a group to secure their upper ends to said cap, so that said posts are biased outwardly at their upper ends against said cap.

* * * * *